US006497589B1

(12) United States Patent
Hutchinson et al.

(10) Patent No.: US 6,497,589 B1
(45) Date of Patent: Dec. 24, 2002

(54) METHODS AND APPARATUS FOR ELECTRICAL CONNECTIONS

(75) Inventors: Rick Neil Hutchinson, Cincinnati, OH (US); Stephen Charles Hanak, Middletown, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/715,322

(22) Filed: Nov. 17, 2000

(51) Int. Cl.[7] ..... H01R 13/648
(52) U.S. Cl. ..... 439/607; 439/587
(58) Field of Search ..... 439/607, 610, 439/587, 589, 274, 275, 460

(56) References Cited

U.S. PATENT DOCUMENTS 5,580,264 A * 12/1996 Aoyama et al. ..... 439/275
5,865,636 A 2/1999 Myer et al.
6,132,250 A * 10/2000 Shinozaki et al. ..... 439/587
6,196,873 B1 3/2001 Murakami et al.
6,203,348 B1 3/2001 Fukuda
6,231,388 B1 5/2001 Murakami et al.

* cited by examiner

*Primary Examiner*—Khiem Nguyen
(74) *Attorney, Agent, or Firm*—Nathan D. Herkamp; Armstrong Teasdale LLP

(57) ABSTRACT

An electrical connector including a wire clamp that restricts wire movement within an electrical connector assembly to facilitate reducing wire chafing and arcing is described. The electrical connector assembly couples to at least one wire and also includes a backshell. The wire extends from an overbraid through the connector assembly to electrical pins. The backshell includes an overbraid clamping portion that includes exterior and interior surfaces, and an opening extending therebetween. The wire clamp includes two body portions that define at least one opening sized to receive the wire. A plurality of ribs extend into each wire clamp opening.

18 Claims, 2 Drawing Sheets

METHODS AND APPARATUS FOR ELECTRICAL CONNECTIONS

BACKGROUND OF THE INVENTION

This invention relates generally to electrical connectors and, more particularly, to methods and apparatus for making electrical connections.

Complex wiring harnesess include electrical connector assemblies that connect wires leading from one system to another system. Known connector assemblies include a connector backshell. At least one wire is routed through the backshell and electrically connected to electrical contacts that include pins or sockets contained within the harness. A wire overbraid is installed circumferentially around the backshell to prevent the wires from being inadvertently pulled from the electrical connector assembly. The overbraid is terminated with a banding clamp.

Typically the connector assemblies contain electrical sockets that include a machined tube and leaf spring design that provide a contact force to retain pins extending from a mating connector within the socket. Due to the stiffness of the insulated wire, and since the wires are unrestrained within the backshell, relative motion between the system coupled to the connector assembly system and the system coupled to the receiving socket may induce vibration forces the pins. Additionally, motion may induce vibrations into the pins that is then induced into the wire. Such vibrations may cause arcing between the leaf spring and the mating pins, between adjacent contacts, or between the pins and the socket. Over time, continued arcing may lead to overheating of the connection and/or eventual failure of the connector assembly.

BRIEF SUMMARY OF THE INVENTION

In an exemplary embodiment, a wire clamp restricts wire movement within an electrical connector assembly and facilitates a reduction in arcing within the electrical connection and facilitates a reduction of wire chafing a backshell. The electrical connector assembly couples to at least one wire and includes the backshell and the wire clamp. The wire extends from an overbraid through the backshell to the electrical connector assembly to connect to electrical pins contained within the electrical connector assembly. The backshell includes an overbraid clamping portion including an exterior surface, an interior surface, and an opening extending therebetween. In the exemplary embodiment, the wire clamp includes a single or a multiple split body portion that defines at least one opening for receiving the wire. A plurality of ribs extend into each wire clamp opening and a banding clamp extends circumferentially around the backshell overbraid clamping portion.

In use, at least one of the portions of the wire clamp is inserted through the backshell opening and the wire is routed through the backshell. In a multi-split body portion, the second wire clamp portion is attached to the first wire clamp portion and the backshell overbraid clamping portion is inserted within the overbraid. The banding clamp is tightened around the overbraid and forces the first and second body wire clamp body portions together such that the ribs secure each wire to the backshell. The wire clamp restricts motion of the wires within the backshell, thus limiting motion of the electrical pins. As a result, the wire clamp facilitates reducing arcing between the electrical pins as a result of movement, and facilitates eliminating wire chafing within the backshell.

DETAILED DESCRIPTION OF THE INVENTION

Figure 1:
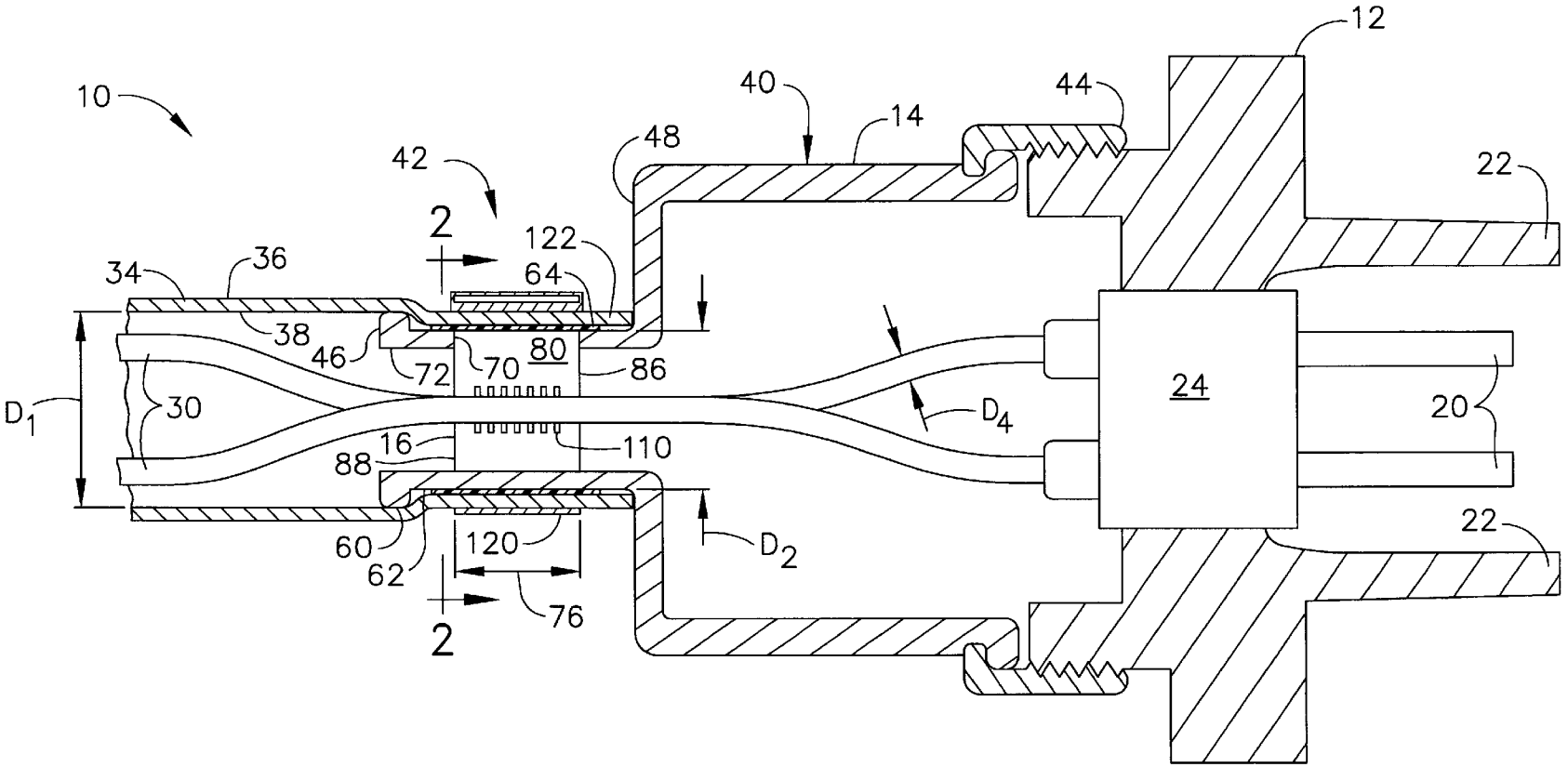
FIG. 1 is a side cross-sectional view of an electrical connector assembly.
Figure 2:
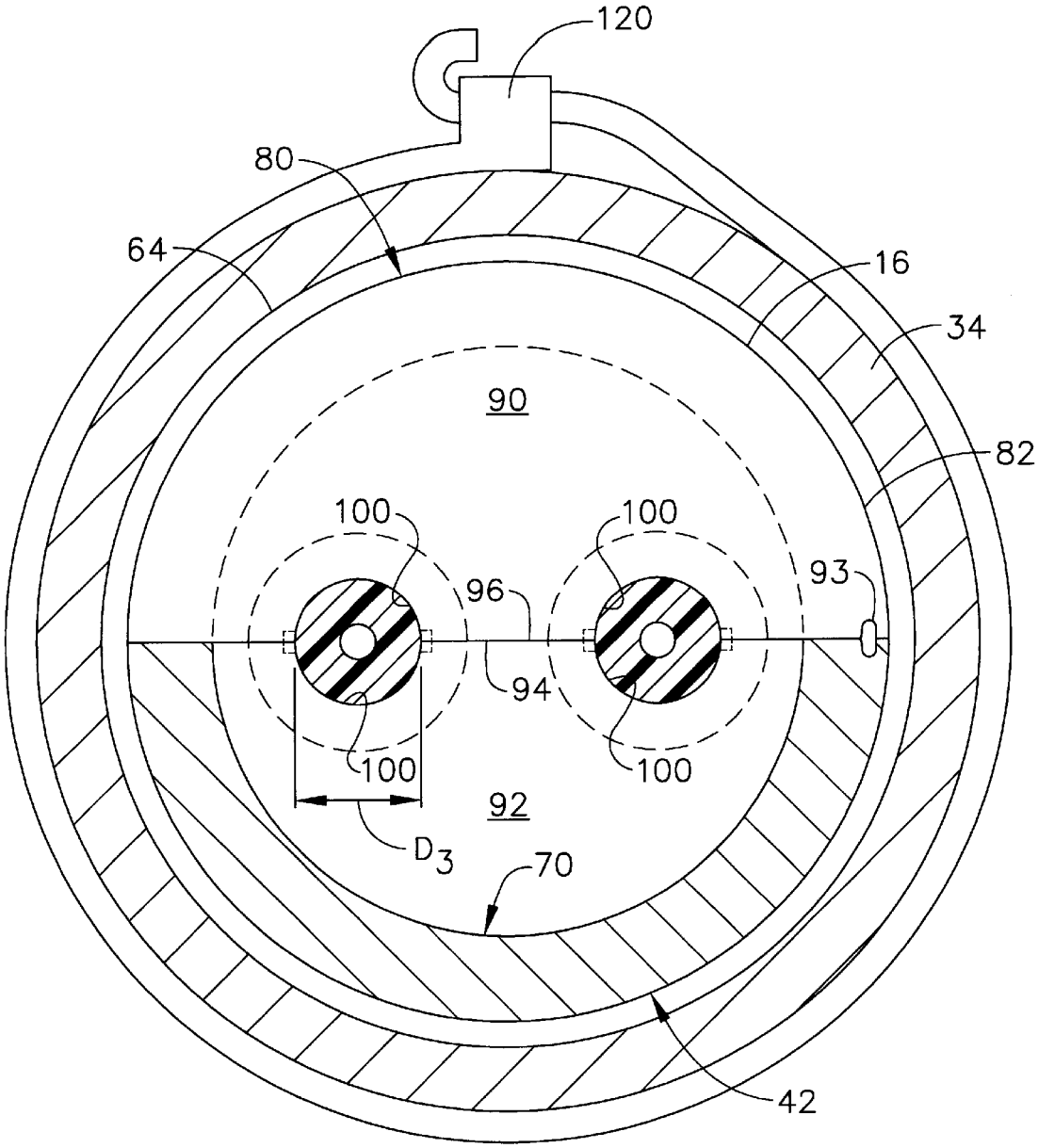
FIG. 2 is a cross-sectional view of the electrical connector assembly shown in FIG. 1 taken along line 2—2.

FIG. 1 is a side cross-sectional view of an electrical connector assembly 10 and FIG. 2 is a cross-sectional view of electrical connector 10 taken along line 2—2 shown in FIG. 1. Electrical connector assembly 10 includes a connector 12, a backshell 14, and a wire clamp 16. Connector 12 is known in the art and includes at least one electrical pin 20 and a connector shell 22. In the exemplary embodiment, connector 12 includes two electrical pins 20 and one connector shell 22. Connector shell 22 extends outward and permits electrical connector assembly 10 to be coupled to an electrical system (not shown) such that electrical pins 20 are received in electrical contact within an electrical receptacle.

Electrical pins 20 extend outward through a connector insert 24 anchored inside connector shell 22. At least one insulated wire 30 extends through backshell 14 and wire clamp 16 to electrically connect to an electrical pin 20. In the exemplary embodiment, electrical connector assembly 10 includes two wires 30. In one embodiment, wires 30 are fluorocarbon insulated wires. Wires 30 are insulated within a protective overbraid 34 that extends circumferentially around wires 30. Overbraid 34 includes an exterior surface 36 and an interior surface 38, and has a substantially circular cross-sectional profile. Overbraid interior surface 38 defines an interior diameter $D_1$.

Backshell 14 includes a connector interface portion 40, an overbraid clamping portion 42, a first end 44, and a second end 46. Connector interface portion 40 extends from overbraid clamping portion 42 to backshell first end 44 and couples to connector 12 to support the wire terminations to electrical pins 20 within electrical connector assembly 10. Overbraid clamping portion 42 is substantially cylindrical and extends from connector interface portion 40 to backshell second end 46. Overbraid clamping portion 42 has a diameter $D_2$ that is smaller than overbraid interior diameter $D_1$, and as such, backshell 14 includes a shoulder 48 extending between overbraid clamping portion 42 and connector interface portion 40. Furthermore, because overbraid clamping portion diameter $D_2$ is smaller than overbraid interior diameter $D_1$, during assembly of electrical connector assembly 10, overbraid clamping portion 42 is inserted within overbraid 34.

An annular shoulder 60 extends radially outward from an exterior surface 62 of overbraid clamping portion 42. During assembly of electrical connector assembly 10, annular shoulder 60 frictionally engages overbraid interior surface 38 to prevent overbraid 34 from uncoupling from backshell 14. An over-wrap of metallic tape 64 extends circumferentially around approximately half of overbraid clamping portion exterior surface 62 between backshell shoulder 48 and overbraid clamping portion shoulder 60. In one embodiment, tape 64 is fabricated from nickel. Tape 64 provides additional protection to electrical connector assembly 10 from electrical magnetic induction (EMI). In an alternative embodiment, electrical connector assembly 10 does not include tape 64.

A slot 70 extends from overbraid clamping portion exterior surface 62 to an interior surface 72 of overbraid clamping portion 42. Slot 70 extends circumferentially around approximately half of overbraid clamping portion exterior surface 62 and has a width (not shown) that is slightly larger than a width 76 of wire clamp 16. In one embodiment, slot 70 is machined into overbraid clamping portion 42.

Wire clamp 16 includes a body 80 including an outer surface 82. Outer surface 82 circumscribes body 80 and has uniform width 76 measured between a first side 86 and a second side 88 of wire clamp 16. In an alternative embodiment, width 76 is variable circumferentially around wire clamp 16. Wire clamp outer surface 82 is curved to approximately match a contour of overbraid interior surface 38. In the exemplary embodiment, wire clamp body 80 also includes a first body portion 90 and an identical second body portion 92.

First body portion 90 and second body portion 92 are connected with a hinge 93 that extends between wire clamp first and second sides 86 and 88, respectively, such that first and second body portions 90 and 92, respectively, are attached in a clam-shell configuration. In an alternative embodiment, first and second body portions 90 and 92 are separate and are not hinged. First and second body portions 90 and 92, respectively, include an inner surface 94 and 96, respectively, and each has a substantially semi-circular cross-sectional profile. Accordingly, when first and second body portions 90 and 92, respectively, are installed, inner surfaces 94 and 96 are in contact and wire clamp body 80 has a substantially circular cross-sectional profile.

First and second body portion inner surfaces 94 and 96, respectively, each include at least one indentation 100 that extends into each inner surface 94 and 96 towards wire clamp outer surface 82. In the exemplary embodiment, first and second body portion inner surfaces 94 and 96, respectively, each include two indentations 100. Each indentation 100 is substantially semi-circular and is aligned such that when inner surfaces 94 and 96 are in contact, indentations 100 combine to define substantially circular openings extending between wire clamp first and second sides 86 and 88 and having a diameter $D_3$. In an alternative embodiment, wire clamp body 80 is one piece and includes two openings (not shown) extending between wire clamp first and second sides 86 and 88. In another embodiment, wire clamp body portions 90 and 92 are fabricated from a flexible material and do not include indentations 100.

Opening defined diameter $D_3$ is larger than a diameter $D_4$ of each wire 30, such that each wire 30 is routed through each opening defined with indentations 100. A plurality of ribs 110 extend radially inward from first and second body portion inner surfaces 94 and 96, respectively, into each indentation 100. Ribs 110 provide a retentive force to secure each wire 30 within each indentation 100.

A banding clamp 120 circumferentially surrounds a portion 122 of overbraid 34 extending around backshell clamping portion 42. More specifically, banding clamp 120 extends circumferentially around overbraid portion 122 to force overbraid 34 against backshell clamping portion 42 between backshell shoulder 48 and overbraid clamping portion shoulder 60. Banding clamp 120 is known in the art.

During assembly of electrical connector assembly 10, initially wire clamp first body portion 90 is inserted within backshell overbraid slot 70 and each wire 30 is routed from overbraid 34 through backshell overbraid clamping portion 42. More specifically, each wire 30 is routed through each indentation 100 of wire clamp first body portion 90. After wire 30 is positioned within each indentation, wire clamp 16 is closed such that second body portion 92 is brought into contact with first body portion 90. More specifically, as wire clamp 16 is closed, second body portion inner surface 96 contacts first body portion inner surface 94, such that each wire 30 is routed through each opening defined with indentations 100. In an alternative embodiment, wire clamp body portions 90 and 92 are fabricated from a flexible material and do not include indentations 100, but rather body portions 90 and 92 flex around wires 30.

Metallic tape 64 is installed around a portion of overbraid clamping portion exterior surface 62. Backshell 14 is then inserted within overbraid 34 such that overbraid portion 122 extends circumferentially around backshell overbraid clamping portion 42 and overbraid clamping portion shoulder 60 contacts overbraid interior surface 38.

Banding clamp 120 is extended circumferentially around overbraid 34 and tightened. More specifically, banding clamp 120 extends circumferentially around overbraid portion 122 and as tightened, forces overbraid 34 against backshell clamping portion 42 between backshell shoulder 48 and overbraid clamping portion shoulder 60. Shoulder 60 prevents overbraid 34 and banding clamp 120 from uncoupling from backshell 14. Furthermore, as banding clamp 120 is tightened, wire clamp body portions 90 and 92 are forced together and overbraid clamping portion ribs 110 prevent wires 30 from being pulled outward from backshell 14.

In use, wire clamp 16 restricts motion of wires 30 within backshell 14, thus limiting motion of electrical pins 20. As a result, wire clamp 16 facilitates reducing arcing between pins 20 and the electrical socket and wire chafing within electrical connector assembly 10. Furthermore, wire clamp 16 prevents wires 30 from being inadvertently pulled from backshell 14. In addition, wire clamps 16 are reusable and may be reinstalled if maintenance is performed to electrical connector assembly 10.

The above-described electrical connector assembly is cost-effective and highly reliable. The electrical connector assembly includes a wire clamp that facilitates a reduction of movement of the wires and the electrical connection pins within the electrical connector assembly. The wire clamp ribs prevent wires from being inadvertently removed from the electrical connector assembly. Because the wires are prevented from moving, less arcing occurs as a result of the pins moving in response to the wires moving. As a result, the wire clamp restricts wire motion within the electrical connector assembly in a cost-effective and reliable manner.

While the invention has been described in terms of various specific embodiments, those skilled in the art will recognize that the invention can be practiced with modification within the spirit and scope of the claims.

What is claimed is:

1. A method for fabricating an electrical connector assembly configured to restrict wire motion within the electrical connector assembly, the electrical connector assembly including a backshell and a wire clamp, the backshell including an overbraid clamping portion including an exterior surface and an interior surface, the wire clamp including a body, said method comprising the steps of:

forming an opening into the backshell overbraid clamping portion extending radially through the backshell clamping portion from the overbraid clamping portion exterior surface to the overbraid clamping portion interior surface;

forming a wire clamp including and at least one opening extending axially through the wire clamp body with respect to a connector assembly centerline and configured to receive at least one wire therethrough; and inserting at least a portion of the wire clamp radially through the backshell overbraid clamping portion opening.

2. A method in accordance with claim 1 wherein said step of forming a wire clamp further comprises the step of forming a wire clamp to include a plurality of ribs configured to secure the wire within the wire clamp.

3. A method in accordance with claim 1 wherein said step of forming a wire clamp further comprises the step of forming the wire clamp body to include a first body portion and a second body portion, wherein the first body portion configured to contact the second body portion to define at least one wire opening extending through the wire clamp.

4. A method in accordance with claim 1 wherein said step of forming an opening into the backshell overbraid portion further comprises the step of extending the opening approximately half-way around the exterior surface of the overbraid portion.

5. A method in accordance with claim 1 wherein said step of forming an opening into the backshell overbraid portion further comprises the step of machining the opening into the backshell overbraid portion.

6. A backshell for an electrical connector assembly, said backshell comprising:

a centerline axis extending axially through said backshell;

an overbraid clamping portion comprising an exterior surface, an interior surface, and an opening extending radially through said overbraid clamping portion from said exterior surface to said interior surface; and a wire clamp comprising a body comprising an outer surface, at least a portion of said wire clamp body inserted through said overbraid clamping portion opening.

7. A backshell in accordance with claim 6 wherein said wire clamp body comprising a first body portion and a second body portion, said first body portion hingedly connected to said second body portion.

8. A backshell in accordance with claim 6 wherein said wire clamp first body portion contacts said second body portion to define at least one wire opening extending through said wire clamp.

9. A backshell in accordance with claim 6 wherein said wire clamp further comprises a plurality of ribs.

10. A backshell in accordance with claim 9 wherein said wire clamp first body portion contacts said second body portion to define at least one wire opening extending through said wire clamp, said ribs extending into said openings.

11. A backshell in accordance with claim 6 wherein said a cross-sectional area of said overbraid clamping portion interior defined by said overbraid clamping portion interior surface is substantially circular.

12. A backshell in accordance with claim 11 wherein said overbraid clamping portion opening comprises a slot extending around approximately half of said overbraid exterior surface.

13. An electrical connector assembly comprising a backshell and a wire clamp, said backshell comprising a centerline axis extending axially through said backshell and an overbraid clamping portion comprising an exterior surface, an interior surface, and an opening extending therebetween; and a wire clamp comprising a body comprising an outer surface, at least a portion of said wire clamp body inserted radially through said overbraid clamping portion opening.

14. An electrical connector assembly in accordance with claim 13 wherein said backshell overbraid opening comprises a slot extending around approximately half of said backshell overbraid exterior surface.

15. An electrical connector assembly in accordance with claim 14 wherein said electrical connector assembly configured to receive at least one wire, said wire clamp configured to secure the wire within said backshell.

16. An electrical connector assembly in accordance with claim 15 wherein said wire clamp further comprises a plurality of ribs configured to secure the wire.

17. An electrical connector assembly in accordance with claim 15 wherein said wire clamp body comprises at least one wire opening sized to receive the wire.

18. An electrical connector assembly in accordance with claim 15 wherein said wire clamp body comprises a first body portion and a second body portion, said first body portion configured to contact said second body portion to define at least one wire opening extending through said wire clamp body.

* * * * *